US005158235A

United States Patent [19]

Johnson

[11] Patent Number: 5,158,235

[45] Date of Patent: Oct. 27, 1992

[54] TURBULENCE-QUELLING FLUID-FLOW CONTROLLER AND METHOD

[75] Inventor: Charles N. Johnson, Racine, Wis.

[73] Assignee: Elwood Hydraulics Company, Inc., Oak Cree, Wis.

[21] Appl. No.: 656,484

[22] Filed: Feb. 19, 1991

[51] Int. Cl.[5] ..... B05B 1/34

[52] U.S. Cl. ..... 239/570; 239/540

[58] Field of Search ..... 239/590, 590.3, 590.5, 239/551, 568

[56] References Cited

U.S. PATENT DOCUMENTS

| | | | |
|---|---|---|---|
| 259,667 | 6/1882 | Churchman | 239/552 |
| 597,842 | 1/1898 | Edmands . | |
| 1,115,533 | 11/1914 | Hartwell | 239/590.5 X |
| 2,341,859 | 2/1944 | Edwards | 299/143 |
| 2,681,830 | 6/1954 | Peterman | 299/113 |
| 2,767,553 | 10/1956 | Lewis | 239/590.5 X |
| 3,273,805 | 10/1966 | Hall | 239/590.3 |
| 3,321,140 | 5/1967 | Parkison et al. | 239/590.3 |
| 3,486,700 | 12/1969 | Bristow | 239/590.5 |
| 3,510,655 | 5/1970 | Gigantino et al. | 239/590 |
| 3,921,912 | 11/1975 | Hayes | 239/242 |
| 4,364,523 | 12/1982 | Parkison et al. | 239/533.14 |
| 4,393,991 | 7/1983 | Jeffras et al. | 239/102 |
| 4,848,672 | 7/1989 | Matsumoto et al. | 239/590.5 |
| 4,899,372 | 2/1990 | Haruch | 239/289 |

FOREIGN PATENT DOCUMENTS

| | | |
|---|---|---|
| 3917657 | 8/1973 | Japan . |
| 4323197 | 9/1977 | Japan . |

*Primary Examiner*—Andres Kashnikow
*Assistant Examiner*—Kevin P. Weldon
*Attorney, Agent, or Firm*—Arthur J. Hansmann

[57] ABSTRACT

A turbulence-quelling fluid-flow controller and method having a housing with a fluid flow passageway and a vane member disposed in the passageway. Inclined surfaces extend on the member between the vanes, and the inclined surfaces and the vanes have the fluid flowing thereagainst and direct the flow to a nozzle, all for quelling turbulence in the flow. The method diverts the flow from the first path and into a second path, at a right angle to the first path, and between vanes, all for quelling.

22 Claims, 2 Drawing Sheets

TURBULENCE-QUELLING FLUID-FLOW CONTROLLER AND METHOD

This invention relates to a turbulence-quelling fluid-flow controller, and, more particularly, it relates to a fluid-flow controller with a nozzle for producing spray of a fluid in a flat pattern, and method.

BACKGROUND OF INVENTION

Turbulence-quelling and fluid-flow controllers utilizing spray nozzles are already well known in the art. That type of nozzle is commonly employed for descaling, such as in the removal of scale from steel which has been heated. In that instance, scale is removed more completely when the spray pattern is optimized by having an optimum laminar flow of fluid going into the nozzle. The prior art achieves a degree of laminar flow by providing means in the flow path in order to quell the turbulence of flow going into the nozzle. Examples of prior art with quelling means are seen in Japanese patent 43-23197 and U.S. Pat. Nos. 2,681,830 and 3,486,700 and 3,510,065 and 3,921,912 and 4,393,991 and 4,899,937.

Additionally, to further quell the turbulent flow of the fluid, cones have been placed in the fluid passageway. Prior art examples are seen in Japanese patent 39-17657 and in U.S. Pat. Nos. 597,842 and 4,848,672. However, in these instances, even though both vanes and cones are utilized integrally, they are not related to where the cone itself is within the confines or extent of the vanes.

The present invention provides for the utilization of vanes and an inclined intervening configuration wherein the fluid flow is directed against the vanes and the incline which together and simultaneously serve to quell the turbulence in the flow so that the fluid can flow to the nozzle in the desired straight or laminar pattern for optimum spray pattern. That is, in the present invention, the fluid is directed to the vanes and against an inclined surface formed and presented between the vanes, and, as such, the turbulence in the fluid is substantially reduced.

Other examples of prior art nozzles are seen in U.S. Pat. Nos. 2,341,859 and 3,273,805 and 4,364,523, but these examples appear to be less pertinent than those mentioned above.

Still further, the present invention provides means for quelling turbulence and also utilizes the turbulent queller member as a flow shutoff or quantity controller in the nature of a poppet. That is, the fluid is directed to the queller member which responds to the force of the fluid to open the flow passageway, and means are applied to the queller member for displacing it to close the fluid passageway in the form of a shutoff valve. This is therefore an automatically piloted shutoff valve as well as a turbulence queller. Therefore, if the fluid pressure is not sufficiently great, then the valve will not open, and conversely, when the pressure has dropped, then the valve will automatically close.

In these accomplishments, the controller body itself is maintained full at all times, and there is elimination of fluid shock, and there is therefore provision for isolating the nozzle, to substitute nozzles according to desired effects, saving of energy and water, if that be the fluid, and there is a stabilization of the fluid flow.

DETAILED DESCRIPTION OF THE PREFERRED EMBODIMENT

Figure 1:
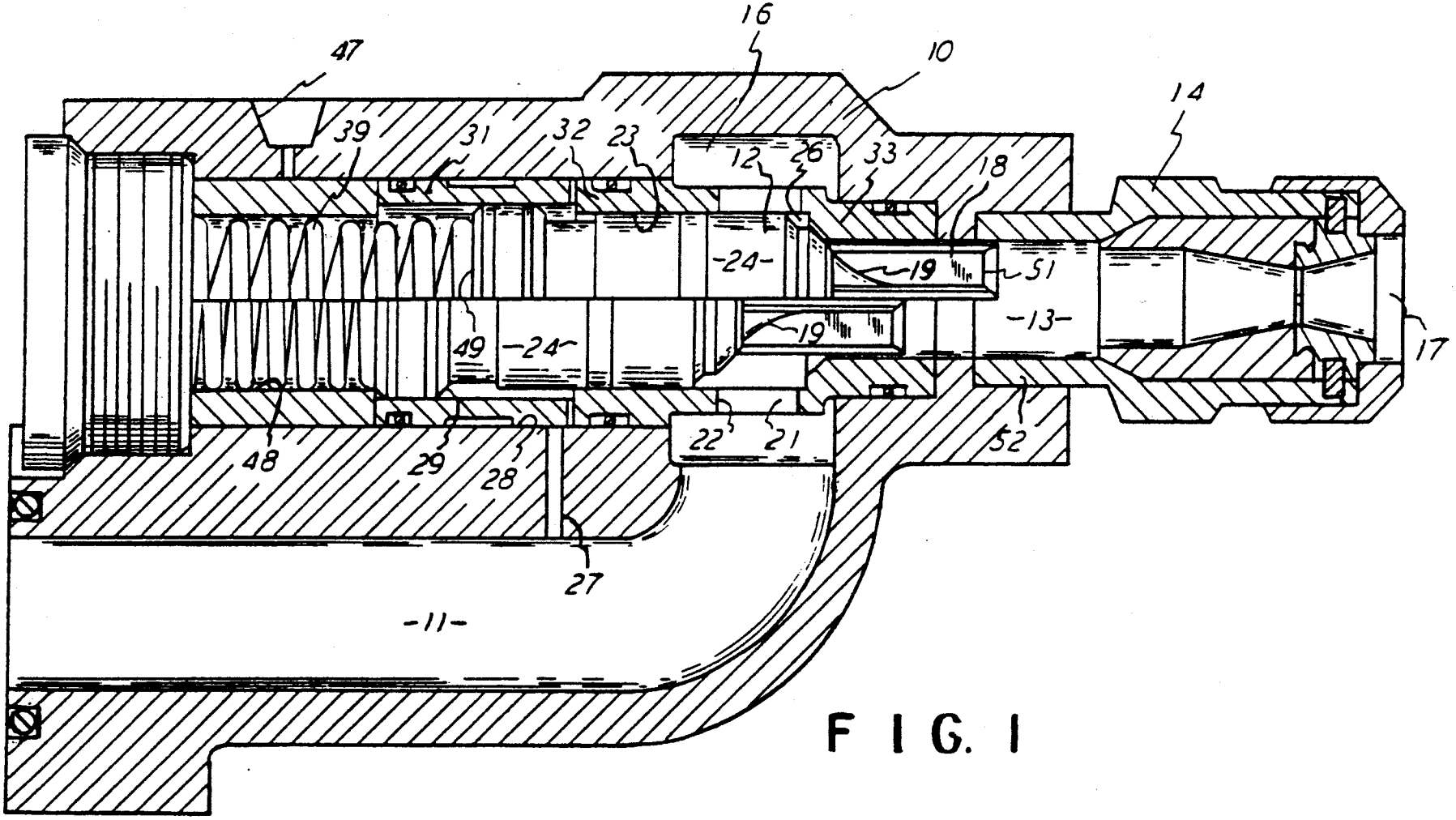
FIG. 1 is a longitudinal sectional view of a preferred embodiment of a controller of this invention.

The drawings show the fluid flow controller of this invention which generally includes a housing 10 having a fluid flow introductory passageway 11 and having a fluid flow queller member 12 movably disposed in a fluid passageway 13 which is in fluid flow communication with a nozzle 14. The fluid, which may actually be liquid or gas, enters the housing 10 in the passageway 11 and flows upwardly, as viewed in FIG. 1, and into an annular passageway 16 defined by the housing 10 and which is in fluid flow communication with the longitudinal passageway 13 leading to the nozzle 14. The nozzle 14 has a suitable fluid flow outlet 17 which presents the spray of the fluid in the desired laminar planar flat spray pattern.

In these arrangements, including those of the prior art, there is a member disposed in the fluid flow passageway for receiving the flowing fluid and quelling the turbulence normally present in the flowing fluid, all so that the fluid can flow to the nozzle, and through its outlet 17, in the desired flat spray pattern for optimum spray effect.

In the present invention, the queller member 12 incorporates a combination of a plurality of vanes 18 and an inclined surface 19 disposed within the radial and longitudinal extent of the vanes 18. Also, the member 12 is disposed in the path of fluid flow and at the juncture of a fluid passageway 21 and the passageway 13. The passageway 21 is actually an annulus formed by the walls 22 in the housing 10 and surrounding the queller member 12, as shown in FIG. 1. It will of course also be seen and understood that the movable queller member 12 is shown in its rightwardly moved position in the upper half of the drawing and is shown in its leftwardly moved position in the lower half of the drawing, for optimum graphic display. That is, the housing 10 has a cylindrical bore 23 which slidably receives the circular portion 24 of the member 12. Fluid pressure in the annulus 21 will reach the portion 26 of the bore 23, and that will be at that the right hand face of the member 12, and that will therefore urge the member 12 leftwardly from its upper half position and to its lower half position, as viewed in FIG. 1. Also, a fluid passageway 27 extends from the passageway 11 and into the bore 28 in the housing 10 to further urge the member 12 leftwardly with the pressure exerted against the annulus 29 of the member 12.

In this arrangement, it will also be seen and understood that there are rings 31 and 32 affixedly disposed in the housing 10 for respectively movably piloting the member 12 at its respective left and right ends. It will also be seen and understood that the housing bore 23 is actually presented by a ring 32 which is fixedly disposed within the housing bore 28, and the face of ring 23 is the annular surface 22 which, in opposition and conjunction with the ring 33, presents the annular passageway 21.

Figure 3:
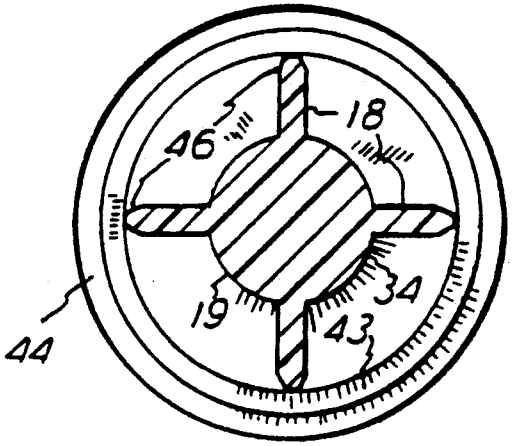
FIG. 3 is a sectional view taken on the line 3—3 of FIG. 2.
Figure 2:
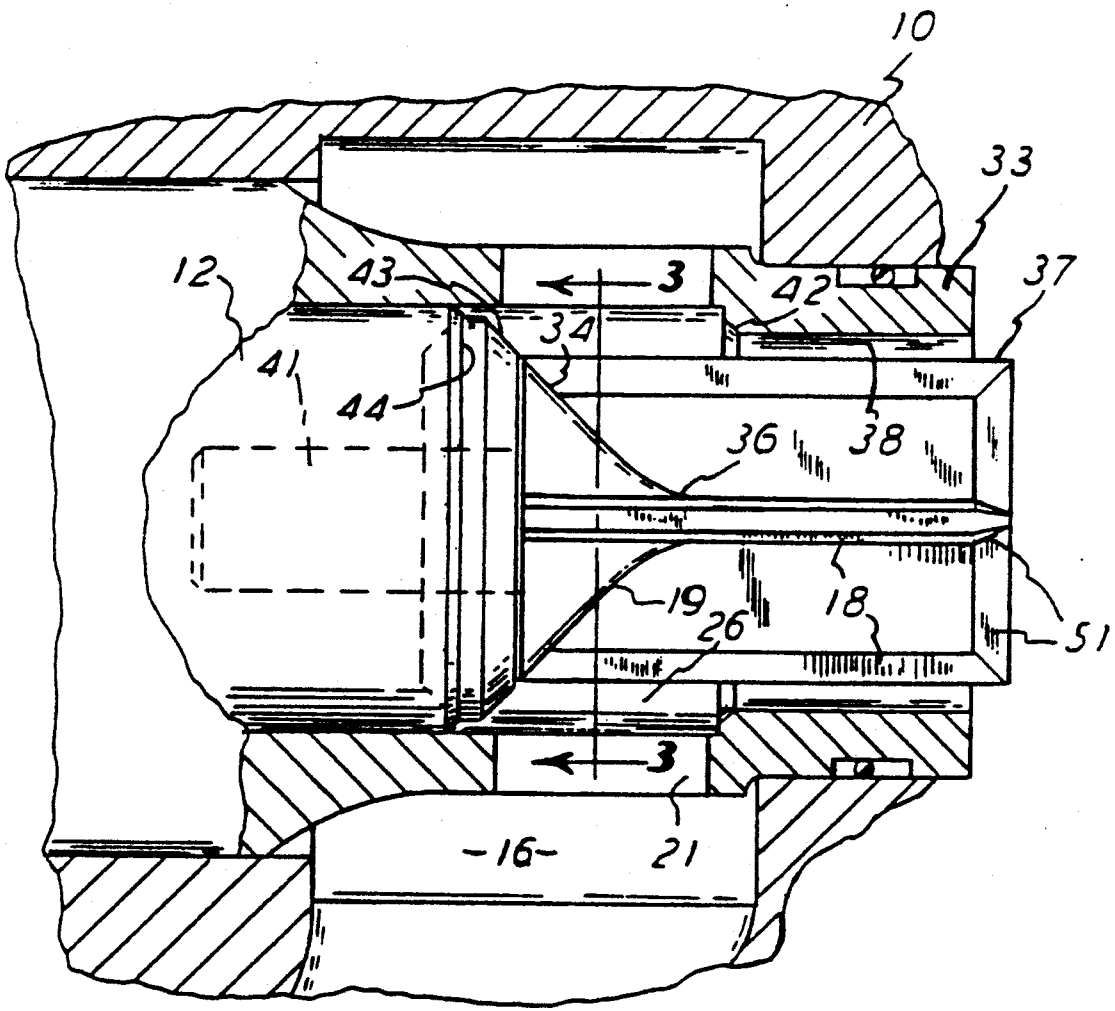
FIG. 2 is an enlargement of a central portion of FIG. 1, with some parts slightly altered.

The member 12 includes the three basic portions as the vanes 18, the inclined surface 19, and the cylindrical surface 24. The vanes 18 are disposed to extend radially, as best shown in FIG. 3, and also longitudinally, as best shown in FIGS. 1 and 2, relative to the longitudinal axis along the horizontal center line of FIG. 1 and this is also the longitudinal axis of the fluid passageway 13. Four vanes 18 are shown, and they extend for substantially four times the radial dimension, that is, the length of the vanes, along passageway 13, and is shown to be four times the height which is the radial dimension of the vanes in the passageway 13.

Disposed within the longitudinal and radial extents of the four vanes 18, are the inclined surfaces 19 which are actually shown to be slightly concave and which of course blend with the surfaces of the vanes 18, as best shown in FIG. 2. Of course there is the inclined surface 19 between every two vanes 18, and that makes for the four inclined surfaces 19 to match the four vanes 18. The vanes 18 are therefore disposed toward the downstream end of the passageway 13 while the inclined surfaces 19 are disposed toward the upstream end of the passageway 13. Further, the axial extent or projection of the inclined surface 19, that is along the axis of the passageway 13, is less than one-half of the length of each vane 18 along the passageway 13. Also, the inclined surfaces 19 each extend from the radially outer extent of each vane 18, as at location 34, and the inclined surfaces 19 extend radially inwardly to a cross-sectional dimension equal to the thickness of the vanes at the locations designated 36.

Because the member 12 is movable within the housing 10, the member is piloted on its cylindrical surfaces 24, and the radial limit 37 of each of the vanes 18 is spaced from the cylindrical surface 38 defined by the ring 33 and surrounding the vanes 18.

The operation of the member 12 is such that when fluid pressure is sufficient in the annulus 21, the fluid causes the member 12 to move leftwardly, such as to the position in the lower half of FIG. 1. At that time, fluid is impinged against the inclined surfaces 19 and the vanes 18. As such, the turbulence in the fluid is quelled or substantially diminished and of course the flow continues on in the passageway 13 and into the nozzle 14 and out the outlet 17. In this arrangement, the fluid is simultaneously encountered by the inclined surfaces 19 and the vanes 18, rather than sequentially. Also, as indicated, the member 12 acts as a poppet in responding to fluid pressure to move leftwardly, as described, and of course only adequate pressure will cause the leftward movement because the member 12 is under the influence of a compression spring 39 which urges the member 12 rightwardly and against the fluid pressure. Of course there could be other means, including even a manually operated screw, which could position the member 12 rightwardly, instead of the spring 39, as one skilled in the art will readily understand. Also, FIG. 2 indicates that the member 12 can be made in two pieces, one being the right end as viewed in FIG. 2, and the other being the circular portions to the left end, and the two ends can be held together by a threaded stud 41 extending therebetween, but the member 12 can also be a one-piece member.

The housing ring 33 presents an annular valve seat 42 for fluid-tightly matching with an annular and conical valve closure 43 on the member 12. When the two members are in the seated or contact position, such as at the upper half of FIG. 1, then fluid will not flow through the passageway 13, at least not until the fluid pressure is sufficient in the annulus 26, as mentioned. Also, FIG. 2 shows that the member 12 has an outer ring 44 extending radially beyond the closure portion 43, and the ring 44 is thus subject to receiving the fluid pressure in the chamber 26 for the operation of opening the valve member 12. The arrangement is such that the fluid can be retained in the passageways 11 and 21 until fluid pressure is sufficient to cause the combined queller and valve member 12 to move leftwardly.

It should also be noticed that the radially outer ends of the vanes 18 are tapered, such as at the tapers designated 46, and this further assists the quelling of turbulence when the fluid flows toward the member 12 in the area of the closure portion 43 and that flow would be at a right angle to the longitudinal axis of the member 12 when flow is approaching from the annulus 21. That is, the member 12 is at the juncture of the annulus 21 and the longitudinal passageway 13 when the flow is considered to be coming radially inwardly from the passageway 21.

In this arrangement, the member 12 is preferably made of a non-metallic material, and the entire controller insures that the unit is maintained full-fluid at all times, and it eliminates fluid shock, and it provides for nozzle isolations, and it saves energy and reduces water usage, and it of course stabilizes the flow in turbulence thereby improving descaling. In operation, when the main valve leading to the assembly is open, then the assembly itself automatically opens under appropriate pressure and it will of course remain open until the main valve is closed, at which time the member 12 will seat itself and will retain the fluid pressure therein so there will be no need for prefilling, and there will be no undesired leakage from the nozzle.

In addition to the spring 39, or the like means for urging the member 12 rightwardly against fluid pressure, there is shown a fluid pilot opening 47 which leads into the compartment 48 for the spring 39 and thus presents fluid against the surface 49 of the member 12 to urge the latter rightwardly, if and when desired.

Where the member 12 is made of two pieces of different material, such as the non-metallic material for the vanes and the inclined surfaces and the valve closure portion, then the cylindrical portion 24 can be made of metal for good sliding contact in the bore 23. Of course it will also be noticed that there are suitable 0-rings distributed in the four places throughout the shown assembly for the usual fluid-tight sealing. Also, the longitudinal ends 51 of the vanes 18 are tapered and are shown to extend into the cylindrical end 52 of the nozzle 14 which can be threaded into the housing 10.

The method aspect of this invention is understood by virtue of the aforementioned description of the apparatus. Specifically, the method is effective to apply the quelling features to the flowing fluid and to thereby alter the condition of the flowing fluid. Actually, fluid, under pressure in the passageway 11 is introduced into the annular pattern at the space designated 21 and thus completely surrounding the member 12. Therefore, in operation, with the member 12 leftwardly, as shown in the lower half of FIG. 1, the flowing fluid is directed against the inclined surface 19, which is of course an oblique surface with regard to the radially inward direction of the fluid relative to the annulus 21. At this point, that is the first path of the direction of fluid flowing. The fluid pressure and the angulation of the oblique surfaces 19 cause the fluid to be diverted to the second path of flow, namely, toward the nozzle 14 or along the longitudinal axis of the apparatus, as seen in FIG. 1.

Also, throughout this time, the fluid is confined between every two vanes 18, and this is of course confining the fluid in the direction of the second path of flow. Of course the vanes 18 extend parallel to the path of the flowing fluid which comes into the entryway 21 and 26 and is then directed at a right angle and into the passageway 13 and then to and through the nozzle 14 where it passes through the slotted outlet 17 for the non-turbulent spray pattern desired.

Both the apparatus and method therefore provide for segmenting the flow of the fluid. In the embodiment shown, and in the method, the segmentation is into one-quarter amounts for the total flow, and that is determined by the four vanes which flank the four intervening inclined portions 19.

What is claimed is:

1. A turbulence-quelling fluid-flow controller comprising a housing with a fluid-flow passageway therein and with said passageway being of only one internal diameter along a longitudinal length thereof, a fluid-flow outlet nozzle attached to said housing in fluid-flow communication therewith for the outlet flow of fluid from the controller at the downstream end of the flow of fluid through the controller, a member disposed in said passageway and extending therealong in the path of flow and including vanes at the downstream end of said member relative to said passageway and extending lengthwise longitudinally and heightwise radially in said length of said passageway and with said vanes being completely within the length of said passageway, said vanes having radially inward ends of said member and having radially outer ends disposed away from said member, and said member being movable in said passageway for regulating fluid flow through said passageway and including a circular portion at the upstream end of said member and extending at an inclined angle along and completely within the length of said vanes from the radially outer ends of said vanes to the radially inward ends of said vanes.

2. The turbulence-quelling fluid-flow controller as claimed in claim 1, wherein the length of said circular portion is less than the length of said vanes along said passageway.

3. The turbulence-quelling fluid-flow controller as claimed in claim 1, wherein said passageway includes a downstream length and an upstream length, said upstream length being disposed to intersect said downstream length at a right angle to said downstream length, and with said circular portion being disposed at the juncture of said upstream and said downstream lengths.

4. The turbulence-quelling fluid-flow controller as claimed in claim 1, wherein the axial length of said circular portion is less than the length of said vanes along said downstream length of said passageway and said circular portion is located upstream relative to the total length of said vanes along said passageway.

5. The turbulence-quelling fluid-flow controller as claimed in claim 1, wherein said housing has a valve seat and said member has a valve closure for mating with said seat to interrupt fluid flowing through said passageway.

6. The turbulence-quelling fluid-flow controller as claimed in claim 1, including means operatively associated with said member for moving said closure toward said valve seat.

7. The turbulence-quelling fluid-flow controller as claimed in claim 1, wherein said means is a compression spring yieldingly urging said member toward said valve seat and against the force of fluid in said passageway.

8. The turbulence-quelling fluid-flow controller as claimed in claim 1, wherein said valve closure is of a non-metallic material for conforming to said valve seat under the urging of said closure onto said valve seat.

9. The turbulence-quelling fluid-flow controller as claimed in claim 1, wherein said housing has a cylindrical bore for snugly slidably receiving said member and thereby piloting said member in the movement of said member in said passageway.

10. A turbulence-quelling fluid-flow controller comprising a housing having a fluid-flow inlet and a fluid-flow outlet and an intermediate fluid-flow passageway having a longitudinal axis and a uniform internal diameter along a length of said axis, a nozzle attached to said housing in fluid-flow communication with said housing outlet, a plurality of spaced-apart vanes extending radially and along said passageway and having radially inner ends and radially outer ends with all ends being radial in relationship to said longitudinal axis and with said vanes being completely within said length of said axis, an inclined portion connected with and being in the space between said vanes to thereby be within the limit of both the length and radial extent of the radially outer ends of said vanes and extending at an inclination from said radially outer ends of said vanes to said radially inner ends of said vanes and with said inclination thereby being pointed toward said nozzle and being in the path of fluid flow for quelling the turbulence of flow toward said nozzle, said vanes and said inclined portion being one integral member and being movable in said passageway for regulating fluid flow through said passageway.

11. The turbulence-quelling fluid-flow controller as claimed in claim 1, wherein the length of said inclined portion is less than the length of said vanes along said passageway.

12. The turbulence-quelling fluid-flow controller as claimed in claim 10, wherein said passageway includes a downstream length and an upstream length, said upstream length being disposed at a right angle to said downstream length, and with said inclined portion being disposed at the juncture of said upstream and said downstream lengths.

13. The turbulence-quelling fluid-flow controller as claimed in claim 10, wherein the axial length of said inclined portion is less than the length of said vanes along said downstream length of said passageway and said inclined portion is located upstream relative to the total length of said vanes along said passageway.

14. The turbulence-quelling fluid-flow controller as claimed in claim 10, wherein said housing has a valve seat and said member has a valve closure for mating with said seat to interrupt fluid flowing through said passageway.

15. The turbulence-quelling fluid-flow controller as claimed in claim 10, including means operatively associated with said member for moving said closure toward said valve seat.

16. The turbulence-quelling fluid-flow controller as claimed in claim 10, wherein said means is a compression spring yieldingly urging said member toward said valve seat and against the force of fluid in said passageway.

17. A turbulence-quelling fluid-flow controller comprising a housing with a fluid-flow passageway therein, a fluid-flow outlet nozzle attached to said housing in fluid-flow communication therewith for the outlet flow of fluid from the controller at the downstream end of the flow of fluid through the controller, a member disposed in said passageway and extending therealong in the path of flow and being movable in said passageway for regulating fluid flow through said passageway and including vanes at the downstream end of said member and with said vanes extending lengthwise longitudinally and heightwise radially in said passageway, said vanes having radially inward ends on said member and having radially outer ends disposed away from said member, and said member having a circular portion at the upstream end of said member and extending at an inclined angle along the length of said vanes from the radially outer ends of said vanes to the radially inward ends of said vanes.

18. The turbulence-quelling fluid-flow controller as claimed in claim 17, wherein said housing has a valve seat and said member has a valve closure for mating with said seat to interrupt fluid flowing through said passageway.

19. The turbulence-quelling fluid-flow controller as claimed in claim 17, including means operatively associated with said member for moving said valve closure toward said valve seat.

20. The turbulence-quelling fluid-flow controller as claimed in claim 17, wherein said means is a compression spring yieldingly urging said member toward said valve seat and against the force of fluid in said passageway.

21. The turbulence-quelling fluid-flow controller as claimed in claim 17, wherein said valve closure is of a non-metallic material for conforming to said valve seat under the urging of said closure onto said valve seat.

22. The turbulence-quelling fluid-flow controller as claimed in claim 17, wherein said housing has a cylindrical bore for snugly slidably receiving said member and thereby piloting said member in the movement of said member in said passageway.

* * * * *

UNITED STATES PATENT AND TRADEMARK OFFICE

CERTIFICATE OF CORRECTION

PATENT NO. : 5,158,235

DATED : October 27, 1992

INVENTOR(S) : Charles N. Johnson

It is certified that error appears in the above-indentified patent and that said Letters Patent is hereby corrected as shown below:

Column 5, Claim 1, line 31, "of" should read --on--.
Column 5, Claim 4, "claim 1" should read --claim 3--.
Column 5, Claim 6, "claim 1" should read --claim 5--.
Column 5, Claim 7, "claim 1" should read --claim 6--.
Column 6, Claim 8, "claim 1" should read --claim 6--.
Column 6, Claim 11, "claim 1" should read --claim 10--.
Column 6, Claim 13, "claim 10" should read --claim 12--.
Column 6, Claim 15, "claim 10" should read --claim 14--.
Column 6, Claim 16, "claim 10" should read --claim 15--.
Column 8, Claim 19, "claim 17" should read --claim 18--.
Column 8, Claim 20, "claim 17" should read --claim 19--.
Column 8, Claim 21, "claim 17" should read --claim 19--.

Signed and Sealed this

Thirtieth Day of November, 1993

*Attest:*

Bruce Lehman

BRUCE LEHMAN

*Attesting Officer*

*Commissioner of Patents and Trademarks*